US010228126B2

(12) United States Patent
Wadhwa et al.

(10) Patent No.: US 10,228,126 B2
(45) Date of Patent: Mar. 12, 2019

(54) DEVICE AND METHOD FOR GENERATING STEAM

(71) Applicant: KONINKLIJKE PHILIPS N.V., Eindhoven (NL)

(72) Inventors: Sahil Wadhwa, Eindhoven (NL); Yong Jiang, Eindhoven (NL); Wilhelmus Hendrikus Maria Bruggink, Eindhoven (NL); Chen-Shiang Lee, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 15/507,865

(22) PCT Filed: Jul. 20, 2016

(86) PCT No.: PCT/EP2016/067222
§ 371 (c)(1),
(2) Date: Mar. 1, 2017

(87) PCT Pub. No.: WO2017/021141
PCT Pub. Date: Feb. 9, 2017

(65) Prior Publication Data

US 2018/0142883 A1 May 24, 2018

(30) Foreign Application Priority Data

Aug. 4, 2015 (EP) ..... 15179634

(51) Int. Cl.
*D06F 75/06* (2006.01)
*D06F 75/10* (2006.01)
(Continued)

(52) U.S. Cl.
CPC ..... *F22B 27/16* (2013.01); *F22B 1/282* (2013.01); *F22B 1/288* (2013.01)

(58) Field of Classification Search
CPC ..... F22B 35/005; F22B 27/00; F24H 1/10; B01B 1/005; B01D 1/0017;
(Continued)

(56) References Cited

U.S. PATENT DOCUMENTS 1,458,135 A 6/1923 Kato
2,606,272 A 8/1952 Platt
(Continued)

FOREIGN PATENT DOCUMENTS

CN 202208852 U 5/2012
CN 202898841 U 4/2013
(Continued)

*Primary Examiner* — Gregory A Wilson

(57) ABSTRACT

The invention relates to a device for generating steam. The device comprises a water outlet arrangement having an open end to spray water onto a water receiving arrangement. The water receiving arrangement comprises an interior surface defining a chamber in which the open end is arranged so that water sprayed from the open end is sprayed onto the interior surface. The device further comprises a heating element for heating the interior surface up to a temperature for generating steam from water sprayed on the interior surface. The interior surface is formed by two separate cavities, the open end comprising a spray nozzle received within each cavity so that each spray nozzle sprays water onto a region of the interior surface, each region being defined by the cavity in which a respective spray nozzle is received. This allows the water sprayed by the water outlet arrangement be more uniformly spread on the interior surface, leading to more effective heating and more steam may be generated per unit time.

12 Claims, 3 Drawing Sheets

(51) Int. Cl.

| | |
|---|---|
| ***D06F 75/14*** | (2006.01) |
| ***D06F 75/16*** | (2006.01) |
| ***F22B 27/16*** | (2006.01) |
| ***F22B 1/28*** | (2006.01) |

(58) Field of Classification Search
CPC ..... A61L 2209/135; A61L 9/14; A61L 9/18; D06F 75/02; D06F 75/06; D06F 75/08; D06F 75/10; D06F 75/14; D06F 75/16; D06F 75/18; D06F 75/20
See application file for complete search history.

(56) References Cited

U.S. PATENT DOCUMENTS

| | | | | |
|---|---|---|---|---|
| 3,304,636 | A * | 2/1967 | Vieceli | D06F 75/18 38/77.9 |
| 3,828,452 | A * | 8/1974 | Eaton | D06F 75/18 38/77.83 |
| 4,407,235 | A | 10/1983 | Deng | |
| 4,646,122 | A | 2/1987 | Kimura et al. | |
| 5,146,700 | A * | 9/1992 | Prosser | D06F 75/38 38/77.9 |
| 5,161,610 | A * | 11/1992 | Leidinger | B64G 1/50 122/40 |
| 5,666,910 | A | 9/1997 | George, II et al. | |
| 7,100,540 | B2 * | 9/2006 | Vaughan | A01M 15/00 122/40 |
| 8,132,545 | B2 * | 3/2012 | Cho | F22B 1/287 122/40 |
| 8,177,936 | B2 | 5/2012 | Berghaenel | |
| 9,574,765 | B2 * | 2/2017 | Aho | F22B 27/16 |
| 2005/0169614 | A1 | 8/2005 | Zheng | |
| 2016/0161108 | A1 * | 6/2016 | Chua | D06F 75/18 392/399 |

FOREIGN PATENT DOCUMENTS

| | | | |
|---|---|---|---|
| CN | 203174397 | U | 9/2013 |
| GB | 2309071 | A | 7/1997 |
| JP | 2013134022 | A | 7/2013 |
| WO | 2013057651 | A1 | 4/2013 |

* cited by examiner

DEVICE AND METHOD FOR GENERATING STEAM

This application is the U.S. National Phase application under 35 U.S.C. § 371 of International Application No. PCT/EP2016/067222, filed on Jul. 20, 2016, which claims the benefit of International Application No. 15179634.9 filed on Aug. 4, 2015. These applications are hereby incorporated by reference herein.

FIELD OF THE INVENTION

The present invention relates to a device for generating steam as well as to a corresponding method of generating steam.

BACKGROUND OF THE INVENTION

A handheld steamer typically comprises a small water tank, a low flow pump and a lower power steam generation unit in the same handle. In most handheld steamers, the mechanism for steam generation is flash boiling or flow-through heating, depending on the steam rate, wherein steam is produced on demand by pumping—i.e. by dosing water over a hot surface. Steam vents nearby then let the steam out onto the garment. Due to constraints of size and weight for such a product, such steamers tend to produce only limited amount of steam.

For instantaneous steam generation in handheld steamers, large steam rates are harder to achieve in a limited space because this requires managing large volumes of water and energy extraction instantly within the aforementioned limited space. Flow-through heating is often used to increase heat extraction surface for water flowing through, which makes it possible to get higher steam rates, but still not as high as boilers or heating bowl. However, a higher steam rate leads to more scale whenever hard natural water is involved, and the steam rate optimised "labyrinth" designs of flow-through heaters may often end up getting clogged with scale rather quickly. Since the inside of such flow-through heaters cannot be accessed, the clogging cannot be removed/cleaned, leading to the product becoming non-functional.

US 2005/169614 discloses equipment for producing high-pressure saturated steam. The equipment includes a water tank, a pump, a check valve, an atomizing nozzle, a hollow heat chamber and a steam outlet. The pump is connected between water tank and the check valve. The check valve is connected with the heat chamber via the atomizing nozzle. The atomizing nozzle extends into the hollow heat chamber to spray water into the chamber.

OBJECT AND SUMMARY OF THE INVENTION

The invention proposes a device for generating steam that may avoid and/or mitigate the above-mentioned problems.

The invention is defined by the independent claims. The dependent claims define advantageous embodiments.

According to one aspect of the present invention, there is provided a device for generating steam comprising a water outlet arrangement having an open end to spray water. The device also comprises a water receiving arrangement surrounding the open end. The water receiving arrangement comprises an interior surface defining a chamber in which the open end are arranged so that water sprayed from the open end is sprayed on the interior surface. The device further comprises at least one heating element for heating the interior surface up to a temperature for generating steam from water sprayed on the interior surface, wherein the interior surface is formed by two separate cavities and the open end comprises a spray nozzle received within each cavity so that each spray nozzle sprays water onto a region of the interior surface defined by the cavity in which a respective spray nozzle is received.

By providing a water receiving arrangement surrounding the open end of the water outlet arrangement so that the interior surface of the water receiving arrangement defines a chamber in which the open end is arranged, the water sprayed by the water outlet arrangement is more uniformly spread on the interior surface, which may lead to more effective heating and more steam may be generated per unit time.

Further, the need for "labyrinth" designs of flow-through heaters may be avoided, thus reducing the likelihood of clogging.

In a preferred embodiment, the interior surface is curved. A curved interior surface increases the surface area on which the water is sprayed on and leads to more effective heating and steam generation. Scale may be formed on the interior surface. The intermittent expansion of the scale when the surface is heated (when water is not sprayed onto the surface) and contraction of the scale when the surface is cooled (when water is sprayed onto the surface) may cause the scale to flake off the interior surface. The curvature of the surface may further help in the flaking off of the scale.

In a preferred embodiment, the interior surface is concave.

In a preferred embodiment, the at least two separate cavities may be arranged symmetrically along a symmetrical axis.

In a preferred embodiment, the device further comprises a channel fluidly communicating with the chamber, the channel extending through the water receiving arrangement to an outer surface of the water receiving arrangement. The channel allows steam generated from the interior surface to pass through to the outer surface of the water receiving arrangement.

In a preferred embodiment, the device further comprises a receptacle for collecting any scale fallen from the at least one interior surface. The receptacle may be positioned below the interior surface so that scale that is flaked off from the interior surface is collected by the receptable. The receptable may be removeable from the device to make it easy for the user to empty the collected scale.

In a preferred embodiment, the water receiving arrangement comprises a cast material providing thermal contact between the heating element and the interior surface.

In a preferred embodiment, the device further comprises a pump configured to pump water to the water outlet arrangement.

In a preferred embodiment, the device further comprises a trigger mechanism configured to control the pump to pump water to the water outlet arrangement when the trigger mechanism is activated by an user.

In a preferred embodiment, the device further comprises a water tank fluidly communicating with the water outlet arrangement, the water tank being configured to store water sprayed onto the interior surfaces by the water outlet arrangement.

According to another aspect of the present invention, there is provided a method of generating steam in a device for generating steam that comprises a water outlet arrangement having an open end to spray water; a water receiving arrangement surrounding the open end and having an interior surface defining a chamber in which the open end is arranged; and a heating element for heating the interior surface up to a temperature for generating steam; the interior surface being formed by two separate cavities and the open end comprising a spray nozzle received within each cavity, the method comprising the step of:

controlling the spray nozzles so that each nozzle sprays water onto a region of the interior surface defined by the cavity in which a respective spray nozzle is received.

The provision of an interior surface of a water receiving arrangement to surround the end of the water arrangement may cause the water sprayed on the interior surface to be more uniformly spread on the interior surface so that the water is heated more effectively to generate more steam per unit time.

Advantageously, the method may further comprise a step of spraying intermittently onto the interior surface so that the interior surface is alternately heated and cooled. The spraying may be triggered by the user using the trigger mechanism. Any scale deposited on the interior surface may expand when the interior surface is heated. Spraying water intermittently onto the interior surface cools the interior surface, which may cause contraction of the scale. The repeated expansion and contraction of scale may induce the scale to flake off from the interior surface. The scale is thus removed from the interior surface, and the likelihood of built up of scale on the interior surface is reduced.

Advantageously, the method may also comprise the step of holding the device in a substantially vertical manner so that scale formed on the interior surface falls off the interior surface into a receptacle positioned below the interior surfaces when the interior surfaces is alternately heated and cooled. The scale that is flaked off from the interior surface may fall into the receptacle and be collected in a relatively easy manner.

BRIEF DESCRIPTION OF THE DRAWINGS

Embodiments of the invention will now be described, by way of example only, with reference to the accompanying drawings in which.

DETAILED DESCRIPTION OF THE EMBODIMENTS

Figure 1:
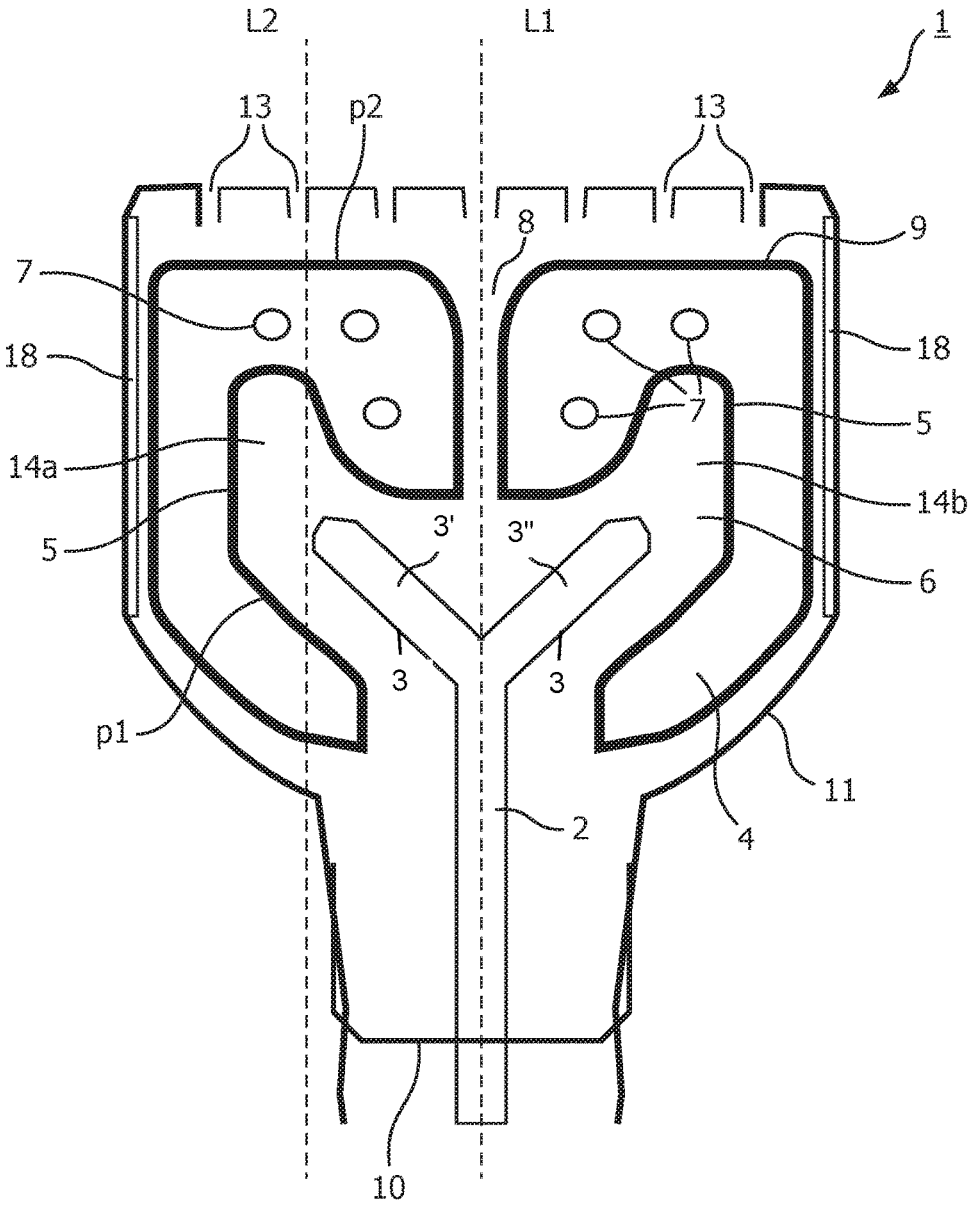
FIG. 1 is a cross sectional view of a portion of a device according to an embodiment of the present invention.
Figure 2:
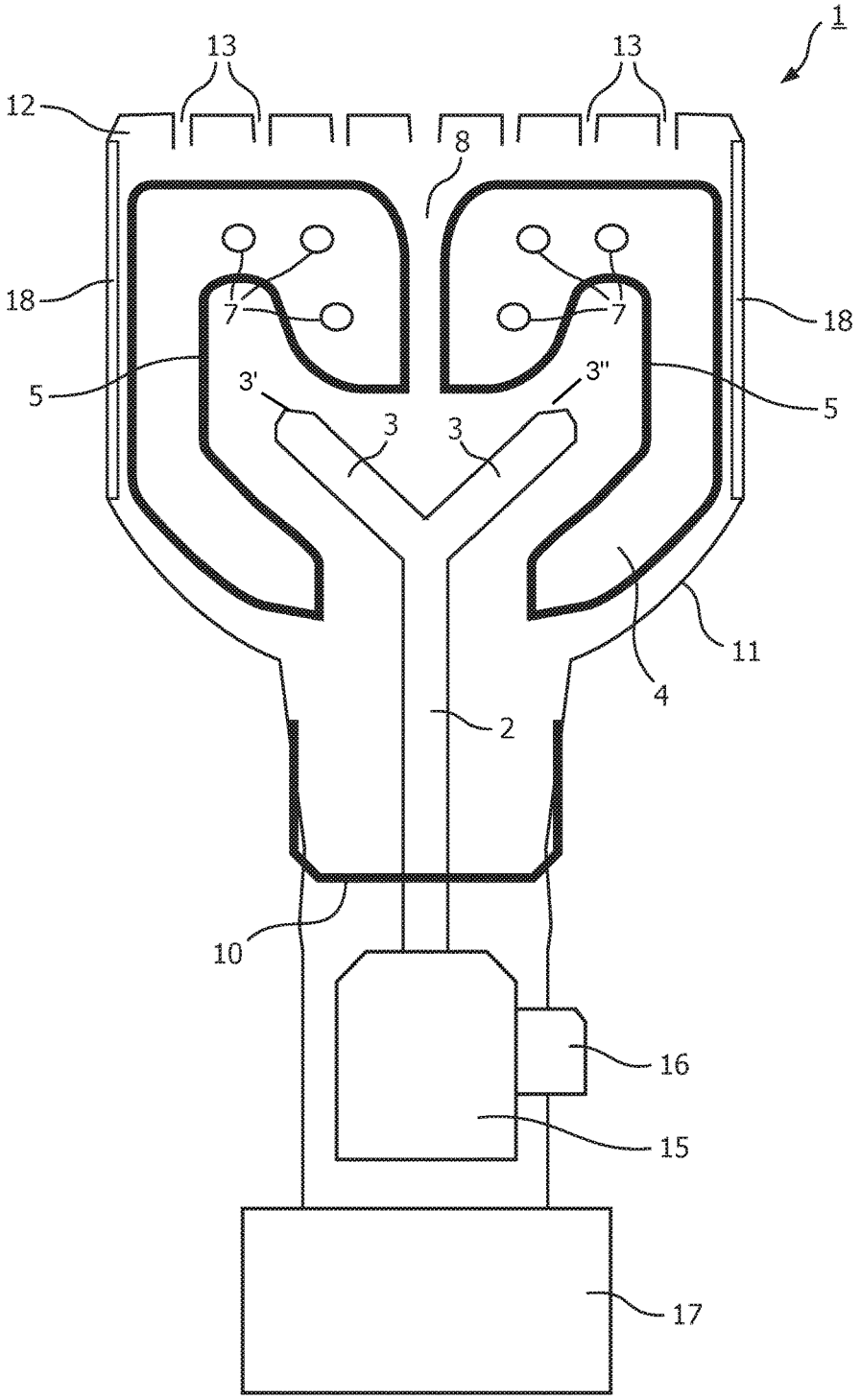
FIG. 2 is a cross sectional view of the entire device according to the embodiment of the present invention illustrated in FIG. 1.
Figure 3:
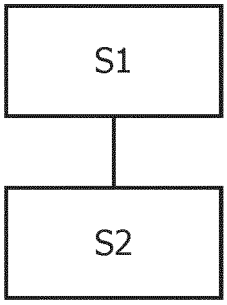
FIG. 3 is a flowchart of a method according to an embodiment of the present invention.
Figure 4:
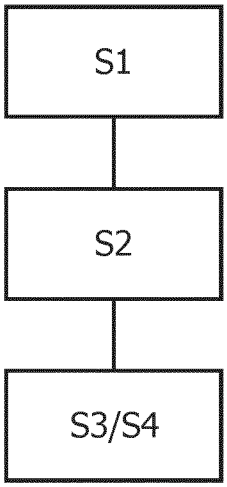
FIG. 4 is a flowchart of a method according to another embodiment of the present invention.

A device (1) according to an embodiment of the invention for generating steam is shown in FIGS. (1) and (2). The device (1) is in the form of a hand-held steamer.

The device (1) comprises a water outlet arrangement (2) having at least one open end (3) to spray water. The device (1) also comprises a water receiving arrangement (4) surrounding the at least one open end (3). The water receiving arrangement (4) comprises at least one interior surface (5) defining a chamber (6) in which the at least one open end (3) are arranged so that water sprayed from the at least one open end (3) is sprayed on the at least one interior surface (5). The device (1) further comprises at least one heating element (7) for heating the at least one interior surface (5) up to a temperature for generating steam from water sprayed on the at least one interior surface (5).

Liquid water is sprayed from the water outlet arrangement (2) through the at least one open end (3) onto the at least one interior surface (5) water receiving arrangement (4). The at least one interior surface (5) is heated by the at least one heating element (7) so the liquid water is evaporated into steam. The liquid water is evaporated into steam using flash boiling. The temperature for generating steam may be for instance, any value within a range from about 100° C. to about 250° C., e.g. about 100° C. to about 200° C., e.g. about 100° C. to about 180° C., e.g. about 100° C. to about 130° C. However, the temperature for generating steam may alternatively be a value outside this range. The actual temperature depends on factors such as pressure.

The at least one interior surface (5) is curved, e.g. in a concave manner. A curved surface provides more surface area compared to a flat surface. The open end (3) of water outlet arrangement (2) may include a nozzle such as a spray nozzle (3'). The spray nozzle (3') is configured to spray liquid water onto a plurality of regions of the at least one interior surface (5). The at least one interior surface (5) may form at least two separate cavities (14*a*, 14*b*), with each cavity receiving one open end of said at least one open end (3). The device (1) illustrated in FIG. 1 shows a first spray nozzle (3') positioned within a first cavity (14*a*) and a second spray nozzle (3") positioned within a second cavity (14*b*). The at least two separate cavities (14*a*, 14*b*) are arranged symetrically along a symetrical axis (L1). As seen from FIG. 1, the water outlet arrangement (2) and the water receiving arrangement (4) may be arranged in a concentric manner. Each of said at least one open end (3) of the water outlet arrangement (2) is arranged between a respective first point (p1) of the interior surface (5) along a respective straight line (L2) substantially parallel to the geometrical symetrical axis (L1) of the device (1), and a respective second point (p2) of the interior surface (5) along the respective straight line (L2). The respective second point (p2) is at a distance distant from the respective first point (p1).

Positioning each spray nozzle (3', 3") within the respective cavity (14*a*, 14*b*) help to spread liquid water more uniformly on the interior surfaces (5) of the respective cavity (14*a*, 14*b*). The surface area of the at least one interior surface is greatly also increased for more effective heating. The curved interior surfaces (5) may allow the hand-held steamer (1) to support a high steam rate of about 40 gm/min while keeping the size of the steamer (1) small.

The device (1) further comprises a channel (8) fluidly communicating with the chamber (6). The channel (8) extends through the water receiving arrangement (4) to an outer surface (9) of the water receiving arrangement (4). The device (1) comprises an external housing (11) with a head (12) having a plurality of openings (13). The plurality of openings (13) may also be referred to as steam vents (13). The steam generated from liquid water on the interior surface (5) travels through the channel (8) to the region between the outer surface (9) of the water receiving arrangement and the head (12), and further through the openings (13) to the external environment. As the steam travels through the channel (8), the steam may get further heated along the way. The steam ejected from the openings (13) is used for treatment of garments.

The water receiving arrangement (4) comprises a cast material providing thermal contact between the at least one heating element (7) and the at least one interior surface (5). The cast material may be a material of a good thermal conductivity. Additionally, the cast material may preferably of relatively light weight and low mass. An example of a cast material may be aluminium. Another example of a cast material (4) may be Zamak. Zamak is an alloy including base of zinc with alloying elements of aluminum, magnesium and copper. The composition of aluminum in Zamak may be about 3% to about 4%. The heating element (7) may be a resistive coil that heat ups due to resistance when a current flows through the coil. In one embodiment, the water receiving arrangement (4) may be a single piece of cast material with channel (8) extending through the cast material (4). In an alternate embodiment, the water receiving arrangement (4) may include several discrete pieces of cast material arranged to define the channel (8).

In one embodiment, the at least one interior surface (5) may be hydrophilic so the liquid water sprayed onto the at least one interior surface (5) would wet the at least one interior surface (5), leading to more effective generation of steam. The at least one interior surface (5) may comprise a coating (not shown) that promotes steam generation. The coating may be, for instance, a colloidal steam promoter. The coating causes the liquid water to spread out on the at least one interior surface (5) such that the liquid water is evaporated into steam more efficiently. Additionally, or alternatively, the coating acts as an insulator to prevent the liquid water being heated too quickly by the at least one heating element (7) and therefore the Leidenfrost effect is alleviated, which otherwise causes a layer of vapour to form between the liquid water and at least one interior surface (5), preventing the liquid water from directly contacting at least one interior surface (5) and effective evaporation of the liquid water into steam. Therefore, the coating is configured to increase the evaporation rate of liquid water into steam. The coating may be porous and may form the interior surface (5) of the water receiving arrangement (4).

The device (1) may further comprise a receptacle (10) for collecting any scale fallen from the at least one interior surface (5). The receptacle (10) may be detachable or removeable from said device (1). The device (1) may include an attachment mechanism (not shown) for reversibly attaching the receptable (10) to said device (1). Prior to use of the device, the receptacle (10) may be attached to the device (1) via the attachment mechanism. For instance, the receptacle (10) may be snapped fitted onto the device (1). When the user wishes to empty the scale from the receptacle (10) after use of the device (1), the user may simply detach the receptacle (10) from the device (1). When the device (1) is held vertically during use of the device, the receptacle (10) is positioned vertically below and facing the at least one interior surface (5). As such, when the device (1) is held vertically during use, the scale flaking off from the at least one interior surface (5) drops directly into the receptacle (10) due to gravity.

A pump (15) is used to pump water to the water outlet arrangement (2). The device (1) may comprise a trigger mechanism (16) (e.g. a button) configured to control the pump (15) to pump water to the water outlet arrangement (2) when the trigger mechanism (16) is activated by an user. The water is then sprayed onto the at least one interior surface (5). The pump (15) may be configured so that the spray dose, i.e. the water sprayed by the water outlet arrangement (2) each time the trigger mechanism (16) is activated, is optimized. The dose should be large enough able to utilize the full thermal energy provided by the heated interior surface (5) to generate steam efficiently and small enough such that the liquid water in each dose is able to be fully converted into steam. The device further comprises a water tank (17) fluidly communicating with the water outlet arrangement (2). The water tank (17) is configured to store water sprayed onto the at least one interior surfaces (5) by the water outlet arrangement (2). When the trigger mechanism (16) is activated, water is pumped from the water tank (17) by the pump (15)

During use, the at least one interior surface is heated by the at least one heating element (7) to the temperature for generating steam from water sprayed on the at least one interior surface (5). When water is sprayed onto the at least one interior surface (5), the at least one interior surface (5) is temporarily cooled. The repeated heating and cooling of the interior surface (5) may help promote flaking of scale built up on the at least one interior surface (5) as the scale undergoes repeated expansion and contraction. After the flake has built up to a certain level, the repeated expansion and contraction may result in cracking and flaking of the built-up scale. In addition, the curvature of the at least one interior surface (5) and the uneven heating of the at least one interior surface (5) due to close proximity of the interior surface (5) to the heating elements (7) may also contribute to flaking. Tests carried out have shown cracking and flaking when the interior surface (5) is curved and when the heating elements (7) are about 2 mm from the surface (5). Flaking may be further increased by having a smooth interior surface (5) so that the attachable surface for the scale to hold on to is reduced. For instance, there is few crevices or bumps on a smooth interior surface to interface with the scale, this reducing adhesion of the scale to the interior surface (5). As the hand-held steamer (1) is held vertically, scale that is flaked off then falls (as a result of gravity) into the receptacle (10) positioned vertically below the at least one interior surfaces (5). The user may then easily remove the receptable (10) to empty the collected scale. Due to automatic flaking of scale when the steamer (1) is in use, the consistency of the performance of the steamer (1) may be improved and the steamer (1) is less likely to degrade quickly over time.

The device (1) may further comprise a power supply (not shown) to supply power for the heating mechanism. The device (1) may also comprise a control mechanism (not shown) to control the heat generated by the at least one heating element (7). In one embodiment, the device (1) may also include a thermal insulating layer (18) between the external housing (11) and the cast material. As the cast material may be close to the external housing (11), the external housing (11) may get heated up easily during use. The thermal insulating layer (18) may control the temperature of the external housing (11) to about 50° C. or below. The insulating layer may include any suitable material such as rubber, polyester felt etc.

A 2000W steam generator with a ~7854 $mm^2$ wetting surface area may be able to sustain a time-averaged steam rate of about 40 gm/min continuously. The corresponding average steam load and power density are respectively about 0.010 g $cm^{-2}$ $s^{-1}$ and 25 W $cm^{-2}$. Experiments pointed out that steam loads of up to levels of 0.020 g $cm^{-2}$ $s^{-1}$ with power densities of up to 50 W $cm^{-2}$ still leads to sufficient flaking of scale layers and contributing to sustained steam performance of the steamer. If the wetting surface area is approximated to a hemisphere, a hemisphere of radius about 36 mm may be required, which is within the design constraints of a hand-held steamer. The hemisphere may occupy about 92,560 $mm^3$ volume. About 250 gm of aluminium may be used as a cast material. Including the weight of other parts such as the heater assembly and the external housing, the total weight may reach 350 gm, which is still within the desired weight limits for a hand-held steamer.

Device (1) may correspond to another hand-held steam applicance, e.g. a steam iron. In other embodiments, the device (1) may instead be a steam appliance with a separate base having a water tank. In one embodiment, the water receiving arrangement (4) and the water outlet arrangement (2) are housed in a head coupled to the base via a hose. The hose channels liquid water from the water tank to the water outlet arrangement (2). The pump may be in the head or the base. In another embodiment, the water receiving arrangement (4) and the water outlet arrangement (2) are housed in the base with the water tank. The liquid water is converted to steam in the base and the hose channels the steam to the head of the steam appliance.

Another aspect of the invention relates to a method of generating steam in a device. The method comprises the steps of:

spraying (S1) water through at least one open end (3) of a water outlet arrangement (2) so that the water is sprayed on at least one interior surface (5) of a water receiving arrangement (4) surrounding the at least one open end (3) of the water outlet arrangement (2), wherein the at least one interior surface (5) of the water receiving arrangement (2) define a chamber (6) in which the at least one open end (3) of the water outlet arrangement (4) is arranged within; and heating (S2) the at least one interior surface (5) up to a temperature to generate steam from water.

Advantageously, the method further comprises an optional step of spraying (S3) intermittently onto the at least one interior surface (5) so that the at least one interior surface (5) is alternately heated and cooled.

Advantageously, the method additionally or alternatively further comprises the step of holding (S4) the device in a substantially vertical manner so that scale formed on the at least one interior surface (5) falls off the at least one interior surface (5) into a receptacle (10) positioned below the at least one interior surfaces (5) when the at least one interior surfaces (5) is alternately heated and cooled.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the spirit and scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A device for generating steam, said device comprising:

a water outlet arrangement comprising:

an open end comprising:

a first spray nozzle and a second spray nozzle;

a water receiving arrangement surrounding the open end, the water receiving arrangement comprising:

an interior surface defining a chamber comprising:

two separate cavities, wherein the open end is configured to:

spray, intermittently water from the first spray nozzle and the second spray nozzle onto the interior surface in a corresponding one of the two separate cavities, wherein the interior surface is heated when water is not sprayed and cooled when water is sprayed; and a heating element configured to:

heat the interior surface of each of the two separate cavities up to a temperature sufficient to generate steam from said water sprayed onto the interior surface.

2. The device according to claim 1, wherein the interior surface of a corresponding one of the first cavity and the second cavity is curved.

3. The device according to claim 1, wherein the interior surface of a corresponding one of the first cavity and the second cavity is concave.

4. The device according to claim 1, wherein the the first cavity and the second cavity are arranged symetrically along a symetrical axis (L1).

5. The device according to claim 1, further comprising:

a channel fluidly communicating with the chamber, the channel extending through the water receiving arrangement to an outer surface of the water receiving arrangement.

6. The device according to claim 1, further comprising:

a receptacle for collecting scale fallen from the interior surface of a corresponding one of the first cavity and the second cavity.

7. The device according to claim 1, wherein the water receiving arrangement comprises:

a cast material providing thermal contact between the heating element and the interior surface.

8. The device according to claim 1, further comprising a pump configured to:

pump water to the water outlet arrangement.

9. The device according to claim 8, further comprising:

a trigger mechanism configured to:

control the pump to pump water to the water outlet arrangement when the trigger mechanism is activated by an user.

10. The device according to claim 1, further comprising:

a water tank fluidly communicating with the water outlet arrangement, the water tank being configured to:

store water sprayed by the water outlet arrangement.

11. A method of generating steam in a device for generating steam, the method comprising:

controlling a spraying of water through an open end of a water outlet arrangement onto an interior surface of a water receiving arrangement surrounding the open end, the interior surface defining a chamber comprising two cavities, heating the interior surface by a heating element up to a temperature for generating steam from the water sprayed onto the interior surface, wherein the open end comprising a spray nozzle received within each cavity, and spraying intermittently onto the interior surface so that the interior surface is alternately heated and cooled.

12. The method according to claim 11, further comprising the step of:

holding the device in a substantially vertical manner so that scale formed on the interior surface falls off the interior surface into a receptacle positioned below.

* * * * *